US009647316B2

(12) United States Patent
Sakurai et al.

(10) Patent No.: US 9,647,316 B2
(45) Date of Patent: May 9, 2017

(54) TRANSMISSION LINE AND ELECTRONIC COMPONENT

(71) Applicant: TDK CORPORATION, Tokyo (JP)

(72) Inventors: Toshio Sakurai, Tokyo (JP); Kiyoshi Hatanaka, Tokyo (JP); Takashi Fukui, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 131 days.

(21) Appl. No.: 14/789,294

(22) Filed: Jul. 1, 2015

(65) Prior Publication Data

US 2016/0013537 A1 Jan. 14, 2016

(30) Foreign Application Priority Data

Jul. 8, 2014 (JP) ..... 2014-140288

(51) Int. Cl.
*H01P 7/10* (2006.01)
*H01P 3/16* (2006.01)

(52) U.S. Cl.
CPC . *H01P 7/10* (2013.01); *H01P 3/16* (2013.01)

(58) Field of Classification Search
CPC ..... H03H 5/00; H03H 5/006; H03H 7/0115; H01F 27/327; H01P 7/10; H01P 3/16
USPC ..... 333/182, 185, 202, 204, 205, 219, 222, 333/219.1
See application file for complete search history.

(56) References Cited

FOREIGN PATENT DOCUMENTS

| | | | |
|---|---|---|---|
| JP | H04-43703 | A | 2/1992 |
| JP | H10-13112 | A | 1/1998 |
| JP | 2007-235630 | A | 9/2007 |

*Primary Examiner* — Robert Pascal
*Assistant Examiner* — Kimberly Glenn
(74) *Attorney, Agent, or Firm* — Oliff PLC

(57) ABSTRACT

A transmission line and an electronic component including a resonator using the transmission line are provided. The transmission line is capable of transmitting electromagnetic waves of at least one frequency ranging from 1 GHz to 10 GHz and is composed of a first dielectric with a first relative permittivity and a surrounding dielectric portion composed of a second dielectric with a second relative permittivity, wherein, the first dielectric is represented by a formula of $\{XBaO.(1-X)SrO\}TiO_2$ ($0.25<X\leq0.55$), and the second relative permittivity is smaller than the first relative permittivity.

8 Claims, 1 Drawing Sheet

TRANSMISSION LINE AND ELECTRONIC COMPONENT

The present invention relates to a transmission line and an electronic component comprising a resonator using the transmission line.

BACKGROUND

In a short range wireless communication or a mobile communication, a microwave band is usually used, particularly the frequency band ranging from 1 GHz to 10 GHz. The communication devices used in these communications are strongly demanded to be downsized and thinned. Also, the electronic component used in the communication devices are also strongly demanded to be downsized and thinned.

The electronic component used in the communication devices includes a component containing a resonator such as a band pass filter. Such a resonator contains a component using a distributed constant line or a component using an inductor together with a capacitor, and each component is provided with a transmission line. In the resonator, the unloaded Q value is required to be relatively high. The unloaded Q value of the resonator can be increased in the resonator by decreasing the loss in the resonator.

The loss in the transmission line includes the dielectric loss, the conductor loss and the radiation loss. The higher the signal frequency is, the more evident the skin effect becomes. Also, the conduct loss will significantly increase. The loss in the resonator almost derives from the conduct loss. Thus, in order to increase the unloaded Q value in the resonator, it will be effective to decrease the conduct loss.

The conventional transmission line for the frequency band of 1 GHz to 10 GHz is one with a structure obtained by combining the conductor and the dielectric. In such a transmission line, it is difficult to decrease the conductor loss to a great extent even if some strategies are applied as described in Patent Document 1 and Patent Document 2. For example, the surface area of the conductor is increased. In this respect, in the resonator using this transmission line, the increase of the unloaded Q value is limited.

On the other hand, the dielectric line is known as a transmission line for transmitting the electromagnetic waves at a millimetric wave band of about 50 GHz. For example, a transmission line has been disclosed in Patent Document 3 which is configured by disposing a tape with a high dielectric constant between two conductor plates parallel to each other and also disposing a filling dielectric made of a material with a low dielectric constant between each conductor plate and the tape with a high dielectric constant. In this transmission line, the electric field of the electromagnetic wave is distributed inside the filling dielectric. It has been described in Patent Document 3 that the actually prepared transmission line has a low dispersing property at the frequency band of 30 GHz to 60 GHz.

Patent Document

Patent Document 1: JP-A-H4-43703
Patent Document 2: JP-A-H10-13112
Patent Document 3: JP-A-2007-235630

SUMMARY

As described above, the conventional transmission line for the frequency band of 1 GHz to 10 GHz has a configuration which uses a line with an electrode made of a conductor. As for such a transmission line, it is difficult to decrease the conductor loss to a great extent even if some strategies are applied as described in Patent Document 1 and Patent Document 2. For example, the surface area of the electrode made of a conductor is increased. In this respect, in the resonator uses this transmission line, the increase of the unloaded Q value is limited.

In another aspect, as described above, the dielectric line is known to transmit the electromagnetic waves at a millimetric wave band of about 50 GHz. However, the dielectric line is never known for the transmit of the electromagnetic waves at a frequency band of 1 GHz to 10 GHz.

The wave length of an electromagnetic wave is inversely proportional to its frequency. The electromagnetic wave at the frequency band of 1 GHz to 10 GHz will have a wavelength that is 5 to 50 times of the electromagnetic wave at a millimetric wave band of about 50 GHz. In general, as the wave length of the transmitted electromagnetic wave becomes longer, the size of the conventional dielectric line will be bigger. Thus, even if the conventional dielectric line is used to form an electronic component such as a resonator for the frequency band of 1 GHz to 10 GHz, the electronic component will be in a larger size and no applicable electronic component can be obtained.

In addition, the wave length of the electromagnetic wave transmitted in the dielectric line becomes shorter than that of the electromagnetic wave transmitted in the vacuum due to the wavelength-shortening effect produced by the dielectric. However, no great wavelength-shortening effect can be obtained in the conventional dielectric line. For example, it has been described in Patent Document 3 that the relative permittivity of the filling dielectric is, for example, 4 or less. When the relative permittivity becomes 4, then the shortening rate of the wave length is 0.5. In this respect, even if the conventional dielectric line is used, the electronic component cannot be downsized to a great extent through the wavelength-shortening effect of the dielectric.

In view of the problems mentioned above, the present invention aims to provide a transmission line and an electronic component which is provided with a resonator using the mentioned transmission line. The transmission line is capable of transmitting electromagnetic waves of one or more frequencies ranging from 1 GHz to 10 GHz and further providing a high unloaded Q value.

The transmission line of the present invention is characterized in that it is provided with a line portion composed of a first dielectric with a first relative permittivity and a surrounding dielectric portion composed of a second dielectric with a second relative permittivity, wherein the first dielectric is represented by a formula of $\{XBaO.(1-X)SrO\}TiO_2$ ($0.25<X\leq 0.55$) and the second relative permittivity is smaller than the first relative permittivity.

It is preferable that the first dielectric further contains MnO. In this case, the first dielectric is presented by the formula of $\alpha\{XBaO.(1-X)SrO\}TiO_2+(1-\alpha)MnO$ ($0.9800<\alpha<1.0000$ and $0.25<X\leq 0.55$).

Preferably, the second relative permittivity is one tenth of the first relative permittivity or even smaller.

The electronic component of the present invention is one containing the transmission line of the present invention. The electronic component of the present invention transmits the electromagnetic waves of one or more frequencies ranging from 1 GHz to 10 GHz and is provided with a resonator. This resonator is configured by using the transmission line of the present invention.

The present invention provides a transmission line and an electronic component which is provided with a resonator using the mentioned transmission line. The transmission line is capable of transmitting electromagnetic waves of one or more frequencies ranging from 1 GHz to 10 GHz and further providing a high unloaded Q value.

DETAILED DESCRIPTION OF EMBODIMENTS

Embodiments

Figure 1:
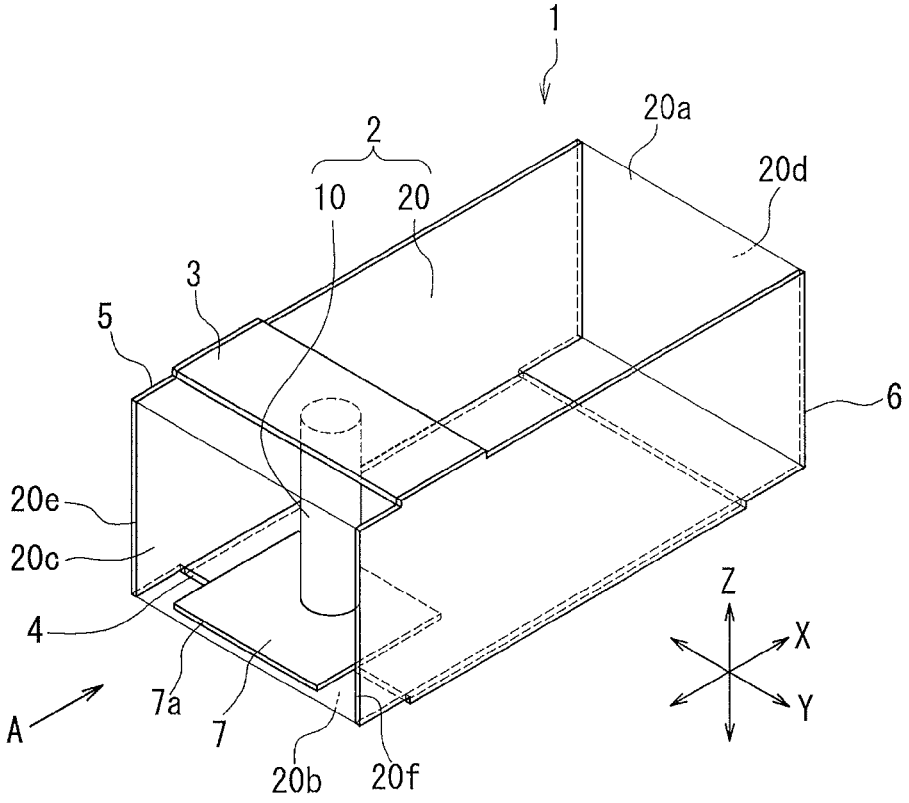
FIG. 1 is a stereogram showing the transmission line and the electronic component in the embodiment of the present invention.

Hereinafter, the embodiments of the present invention will be described in detail with reference to the drawings. Firstly, the configurations of the dielectric line and the electronic component in the embodiment of the present invention will be described with reference to FIG. 1. FIG. 1 is a stereogram showing the transmission line and the electronic component of the present embodiment.

As shown in FIG. 1, an electronic component 1 of the present embodiment contains a transmission line 2 of the present embodiment. The transmission line 2 is provided with a line portion 10 composed of a first dielectric and a surrounding dielectric portion 20 composed of a second dielectric. The line portion 10 transmits the electromagnetic waves of one or more frequencies ranging from 1 GHz to 10 GHz. The surrounding dielectric portion 20 is present around the line portion 10 in a section perpendicular to the direction in which the electromagnetic waves are transmitted in the line portion 10.

The surrounding dielectric portion 20 has an upper surface 20*a* and a lower surface 20*b* which two are located on both ends in the Z direction, two side surfaces 20*c* and 20*d* which two are located on both ends in the X direction, and two side surfaces 20*e* and 20*f* which two are located on both ends in the Y direction.

In particular, in the present embodiment, the whole surrounding dielectric portion 20 is composed of a second dielectric of a single kind.

The electronic component 1 further contains conductor layers 3, 4, 5 and 6 each of which is disposed on the upper surface 20*a*, the lower surface 20*b*, the side surface 20*e* and the side surface 20*f* of the surrounding dielectric portion 20. The length of the conductor layer 3 in the X direction is shorter than that of the upper surface 20*a* also in the X direction. The length of the conductor layer 3 in the Y direction is equal to that of the upper surface 20*a* also in the Y direction. The conductor layer 3 only covers part of the upper surface 20*a*. The length of the conductor layer 4 in the X direction is shorter than that of the lower surface 20*b* also in the X direction. The length of the conductor layer 4 in the Y direction is equal to that of the lower surface 20*b* also in the Y direction. The conductor layer 4 only covers part of the lower surface 20*b*. The conductor layer 5 covers the whole side surface 20*e* and is electrically connected to the conductor layers 3 and 4. The conductor layer 6 covers the whole side surface 20*f* and is electrically connected to the conductor layers 3 and 4. Further, the conductor layers 3, 4, 5 and 6 are connected to the ground.

The electronic component 1 is further provided with a conductor layer 7 disposed inside the surrounding dielectric portion 20 and opposite to the conductor layer 4 with a specified gap interposed therebetween. In addition, a part of the surrounding dielectric portion 20 lies between the conductor layer 4 and the conductor layer 7.

One end of the line portion 10 in the Z direction is connected to the conductor layer 7. The conductor layer 7 has an end portion 7*a* protruding from the side surface 20*c* of the surrounding dielectric portion 20. The other end of the line portion 10 in the Z direction is connected to the conductor layer 3.

The conductor layers 3, 4, 5, 6 and 7 are composed of metals such as Ag and Cu. Further, the electronic component 1 can also be provided with a dielectric layer made of the first dielectric instead of the conductor 3.

Figure 2:
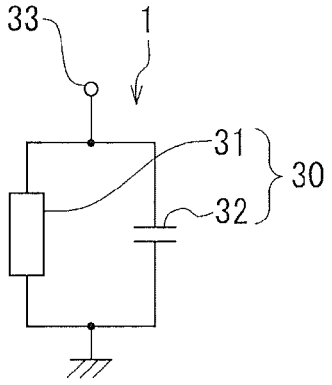
FIG. 2 is a circuit diagram showing the circuit configuration of the electronic component shown in FIG. 1.

Then, the circuit configuration of the electronic component 1 of the present embodiment will be described with reference to the circuit diagram shown in FIG. 2. The electronic component 1 of the present embodiment is provided with a resonator 30 and an input/output terminal 33, wherein the resonator 30 has an inductor 31 and a capacitor 32 connected in parallel. One end of the inductor 31 and one end of the capacitor 32 are electrically connected to the input/output terminal 33. The other end of the inductor 31 and the other end of the capacitor 32 are electrically connected to the ground. Further, the inductor 31 and the capacitor 32 form a parallel resonant circuit. The resonator 30 provides a resonant frequency of 1 GHz to 10 GHz.

The resonator 30 is formed by using the transmission line 2. In particular, the inductor 31 forming the resonator 30 is configured by the line portion 10 in the transmission line 2. In addition, the capacitor 32 is formed by the conductor layers 4 and 7 and part of the surrounding dielectric portion 20 sandwiched between these two conductor layers as shown in FIG. 1. The input/output terminal 33 is formed by the end portion 7*a* of the conductor layer 7 as shown in FIG. 1. Further, a conductor layer coupled to the end portion 7*a* of the conductor layer 7 is disposed on the side surface 20*c* of the surrounding dielectric portion 20. This conductor layer can function as the input/output terminal 33.

Next, the functions of the transmission line 2 and the electronic component 1 in the present embodiment will be described. An electric power of any frequency selected from the frequency ranging from 1 GHz to 10 GHz will be supplied to the input/output terminal 33 formed by the end portion 7*a* of the conductor layer 7. With such an electric power, an electromagnetic wave is excited in the line portion 10 connected to the conductor layer 7. The line portion 10 transmits the electromagnetic wave of one or more frequencies ranging from 1 GHz to 10 GHz. The resonant frequency of the resonator 30 is included in the one or more frequencies of the electromagnetic wave transmitted by the line portion 10. The resonator 30 resonates with a resonant frequency ranging from 1 GHz to 10 GHz. The voltage at the input/output terminal 33 turns to the maximum value when the frequency of the electric power supplied to the input/output terminal 33 is the same with the resonant frequency. On the other hand, it will decrease accordingly when the frequency of the electric power supplied to the input/output terminal 33 deviates from the resonant frequency.

Here, in the transmission line 2, the line portion 10 is represented by the formula of $\{XBaO.(1-X)SrO\}TiO_2$ ($0.25<X\leq 0.55$), and a first dielectric forming the line portion 10 has a first relative permittivity. Further, a second dielectric forming the surrounding portion 20 has a second relative permittivity. In this case, the second relative permittivity is smaller than the first relative permittivity. As for the unloaded Q value when the transmission line and the electronic component are formed into shapes, the unloaded Q value (Qu) is 300 in the prior art when Ag is used in the line portion 10. In order to get a higher Qu value, the present invention is quite necessary. In this way, it is possible to provide a transmission line and an electronic component, wherein the transmission line forms the resonator at a frequency band of 1 GHz to 10 GHz.

The line portion 10 composed of the first dielectric with the first relative permittivity is represented by the formula of $\{XBaO.(1-X)SrO\}TiO_2$ ($0.25<X\leq0.55$). The reasons are provided as follows.

If the unloaded Q value is to be larger than 300 when the transmission line and the electronic component are formed into shapes, the relative permittivity needs to be relatively high and the dielectric loss needs to be relatively low. The presence of $BaTiO_3$ is necessary for the increase of the relative permittivity. However, as $BaTiO_3$ is a ferroelectric material, problems rise regarding the deterioration of relative permittivity and dielectric loss at the frequency band of 1 GHz to 10 GHz required in the present invention. On the other hand, $SrTiO_3$ is a paraelectric material. Although the relative permittivity or the dielectric loss will not deteriorate at the frequency band of 1 GHz to 10 GHz required in the present invention, the relative permittivity will be as low as 300. Thus, when it is $\{XBaO.(1-X)SrO\}TiO_2$, the relative permittivity can be increased and the dielectric loss will be improved at the frequency band of 1 GHz to 10 GHz.

The second relative permittivity is even smaller than the first relative permittivity. The reasons are provided as follows. If the unloaded Q value is to be larger than 300 when the transmission line and the electronic component are formed into shapes, the loss inside the transmission line will be restrained and transmission of electromagnetic waves will be more effective.

In the present embodiment, as for the line portion composed of the first dielectric represented by the formula $\{XBaO.(1-X)SrO\}TiO_2$ ($0.25<X\leq0.55$) and with the first relative permittivity, if the unloaded Q value is to be larger than 300 when the shape of the electronic component is formed, the range of X should range from 0.35 to 0.55. If the unloaded Q value is to be further increased, X should range from 0.26 to 0.35. In addition, the second relative permittivity is necessarily smaller than the first relative permittivity.

In the present embodiment, the following substances can also be contained as the sub-components for the $\{XBaO.(1-X)SrO\}TiO_2$ ($0.25<X\leq0.55$) and with the first particular restriction on the impurities. For example, the oxide and the like of each element selected from the group consisting of Ca, Mg, Al, Zr, Sc, Y, La, Ce, Pr, Nd, Pm, Sm, Eu, Gd, Tb, Dy, Ho, Er, Tm, Yb and Lu can be listed here.

In particular, it is preferable that MnO is further added in the present embodiment. The addition of Mn will improve the sintering property, which will further increase the unloaded Q value. In this respect, as for the line portion composed of the first dielectric represented by the formula of $\alpha\{XBaO.(1-X)SrO\}TiO_2+(1-\alpha)MnO$ ($0.9800<\alpha<1.0000$ and $0.25<X\leq0.55$) and having a first relative permittivity, in order to further increase the unloaded Q value when the shape of the electronic component is formed, it is preferably that $0.9900\leq\alpha<0.9991$ and it is more preferably that $0.9900<\alpha\leq0.9991$ and $0.26\leq X\leq0.35$.

In the present embodiment, the second relative permittivity is preferred to be one tenth of the first relative permittivity or even smaller. In particular, when this value is one tenth of the first relative permittivity or even smaller, the loss inside the transmission line will be restrained and the transmission of the electromagnetic waves will be more effective. Further, no requirement is there for the lower limit of the second relative permittivity. Since it is difficult to use a material with a relative permittivity of 2 or smaller in practice, the second relative permittivity is preferable to be 2 or higher.

The material for the surrounding dielectric portion composed of the second dielectric is not restricted. As the preferable examples, $SrTiO_3$, $CaTiO_3$, $Mg_2SiO_4$, polypropylene, Teflon (registered trademark) and the combination of two of them can be used.

EXAMPLES

The present invention will be described in detail with reference to the Examples and Comparative Examples. However, the following embodiments do not limit the present invention. In addition, the constituent elements described below includes those easily thought of by one skilled in the art and those substantially the same with the described ones. Further, the constituent elements described below can be combined properly.

Example 1

First of all, a dielectric powder for forming the line portion was prepared. The powder of $SrTiO_3$ and that of $BaTiO_3$ were weighted in accordance with the molar ratio between them shown in Table 1. These two kinds of powder were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours.

The pre-calcined powder was fractionated and then mixed with ethanol for 24 hours in a ball mill. After the mixed slurry was heated and dried at 80° C. to 120° C. in several stages, it was cracked by an agate pestle and crossed through a #300 mesh sieve to be granulated so as to provide a dielectric powder having the composition as shown in Table 1.

Commercially available acryl resin based lacquer solution was added to the dielectric powder obtained by the method mentioned above in an amount of 8 mass % in term of the solid content of resins relative to the mass of the dielectric powder. Then, the mixture was mixed in an agate pestle and crossed through a #300 mesh sieve to be granulated. In this way, the granulated powder was obtained. The granulated powder was put into a mold and molded under an increased pressure to provide a formed body sample with a cylindrical shape. After a treatment to remove the binder was done in air at 350° C., the sample was subjected to a thermal treatment at 1400° C. for a certain period of time. Then, it was cooled down to room temperature to finish the sintering process. In this respect, a sintered body of the line portion composed of the first dielectric was obtained.

Then, a dielectric powder for forming the surrounding dielectric portion was prepared. The powder of $MgCO_3$ and that of $SiO_2$ were weighted with the molar ratio between them being 2:1. These two kinds of powder were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours.

The pre-calcined powder was fractionated and then mixed with ethanol for 24 hours in a ball mill. After the mixed slurry was heated and dried at 80° C. to 120° C. in several stages, it was cracked by an agate pestle and crossed through a #300 mesh sieve to be granulated so as to provide a dielectric powder having the composition as shown in Table 1.

Commercially available acryl resin based lacquer solution was added to the dielectric powder obtained by the method mentioned above in an amount of 8 mass % in term of the solid content of resins relative to the mass of the dielectric powder. Then, the mixture was mixed in an agate pestle and crossed through a #300 mesh sieve so as to be granulated. In this way, the granulated powder was obtained. The granulated powder was put into a mold and molded under an increased pressure to provide a formed body sample with a cylindrical shape. After a treatment to remove the binder was done in air at 350° C., the sample was subjected to a thermal treatment at 1400° C. for a certain period of time. Then, it was cooled down to room temperature to finish the sintering process. In this respect, a sintered body of the surrounding dielectric portion composed of the second dielectric was obtained.

Further, with the sintered body of the line portion composed of the first dielectric and the sintered body of the surrounding dielectric portion composed of the second dielectric, a transmission line and an electronic component were formed into shapes as shown in FIG. 1.

TABLE 1

| | x | α | 1-α | Dielectric constant of line portion composed of first dielectric (=first dielectric constant) | Dielectric loss in line portion composed of first dielectric (=first dielectric loss) | Surrounding dielectric portion composed of second dielectric (=second relative permittivity) | Resonant frequency when transmission line and electronic component are formed into shapes (GHz) | Unloaded Q value when transmission line and electronic component are formed into shapes | Assessment compared to unloaded Q value when Ag is used (Qu = 300) |
|---|---|---|---|---|---|---|---|---|---|
| Example 1 | 0.26 | — | — | 651 | 0.00088 | 7 | 6.01 | 380.1 | good |
| Example 2 | 0.30 | — | — | 601 | 0.00093 | 7 | 6.21 | 365.5 | good |
| Example 3 | 0.35 | — | — | 650 | 0.00096 | 7 | 6.33 | 340.4 | good |
| Example 4 | 0.40 | — | — | 795 | 0.00160 | 7 | 6.41 | 335.4 | good |
| Example 5 | 0.45 | — | — | 1270 | 0.00145 | 7 | 6.51 | 320.6 | good |
| Example 6 | 0.50 | — | — | 2001 | 0.00168 | 7 | 6.54 | 314.5 | good |
| Example 7 | 0.55 | — | — | 2825 | 0.00182 | 7 | 6.59 | 310.4 | good |
| Example 8 | 0.26 | 0.9991 | 0.0009 | 656 | 0.00101 | 7 | 6.04 | 363.6 | good |
| Example 9 | 0.26 | 0.9983 | 0.0017 | 668 | 0.00092 | 7 | 6.14 | 356.6 | good |
| Example 10 | 0.26 | 0.9974 | 0.0026 | 657 | 0.00087 | 7 | 6.21 | 355.4 | good |
| Example 11 | 0.26 | 0.9966 | 0.0034 | 678 | 0.00070 | 7 | 6.23 | 347.8 | good |
| Example 12 | 0.26 | 0.9901 | 0.0099 | 679 | 0.00092 | 7 | 6.22 | 344.3 | good |
| Example 13 | 0.30 | 0.9991 | 0.0009 | 606 | 0.00102 | 7 | 6.24 | 363.6 | good |
| Example 14 | 0.30 | 0.9983 | 0.0017 | 648 | 0.00102 | 7 | 6.34 | 356.6 | good |
| Example 15 | 0.30 | 0.9974 | 0.0026 | 687 | 0.00091 | 7 | 6.41 | 355.4 | good |
| Example 16 | 0.30 | 0.9966 | 0.0034 | 717 | 0.00089 | 7 | 6.51 | 347.8 | good |
| Example 17 | 0.30 | 0.9901 | 0.0099 | 719 | 0.00092 | 7 | 6.52 | 344.3 | good |
| Example 18 | 0.35 | 0.9991 | 0.0009 | 654 | 0.00103 | 7 | 6.35 | 333.6 | good |
| Example 19 | 0.35 | 0.9983 | 0.0017 | 687 | 0.00101 | 7 | 6.41 | 328.7 | good |
| Example 20 | 0.35 | 0.9974 | 0.0026 | 723 | 0.00093 | 7 | 6.43 | 325.4 | good |
| Example 21 | 0.35 | 0.9965 | 0.0035 | 757 | 0.00095 | 7 | 6.61 | 320.2 | good |
| Example 22 | 0.35 | 0.9901 | 0.0099 | 761 | 0.00094 | 7 | 6.62 | 319.5 | good |
| Example 23 | 0.40 | 0.9991 | 0.0009 | 798 | 0.00171 | 7 | 6.43 | 320.4 | good |
| Example 24 | 0.40 | 0.9982 | 0.0018 | 824 | 0.00165 | 7 | 6.45 | 319.6 | good |
| Example 25 | 0.40 | 0.9974 | 0.0026 | 846 | 0.00167 | 7 | 6.46 | 315.4 | good |
| Example 26 | 0.40 | 0.9965 | 0.0035 | 867 | 0.00146 | 7 | 6.45 | 311.1 | good |
| Example 27 | 0.40 | 0.9901 | 0.0099 | 871 | 0.00143 | 7 | 6.46 | 308.9 | good |
| Example 28 | 0.45 | 0.9991 | 0.0009 | 1298 | 0.00156 | 7 | 6.55 | 311.4 | good |
| Example 29 | 0.45 | 0.9982 | 0.0018 | 1345 | 0.00146 | 7 | 6.56 | 310.4 | good |
| Example 30 | 0.45 | 0.9973 | 0.0027 | 1378 | 0.00134 | 7 | 6.59 | 309.5 | good |
| Example 31 | 0.45 | 0.9964 | 0.0036 | 1428 | 0.00125 | 7 | 6.61 | 308.2 | good |
| Example 32 | 0.45 | 0.9901 | 0.0099 | 1431 | 0.00131 | 7 | 6.63 | 308.5 | good |
| Example 33 | 0.50 | 0.9991 | 0.0009 | 2013 | 0.00167 | 7 | 6.56 | 305.2 | good |
| Example 34 | 0.50 | 0.9982 | 0.0018 | 2023 | 0.00171 | 7 | 6.55 | 304.5 | good |
| Example 35 | 0.50 | 0.9973 | 0.0027 | 2034 | 0.00175 | 7 | 6.56 | 303.6 | good |
| Example 36 | 0.50 | 0.9964 | 0.0036 | 2043 | 0.00181 | 7 | 6.59 | 304.3 | good |
| Example 37 | 0.50 | 0.9901 | 0.0099 | 2057 | 0.00179 | 7 | 6.61 | 302.5 | good |
| Example 38 | 0.55 | 0.9991 | 0.0009 | 2867 | 0.00179 | 7 | 6.63 | 301.3 | good |
| Example 39 | 0.55 | 0.9982 | 0.0018 | 2901 | 0.00187 | 7 | 6.61 | 301.4 | good |
| Example 40 | 0.55 | 0.9973 | 0.0027 | 2934 | 0.00197 | 7 | 6.63 | 302.1 | good |
| Example 41 | 0.55 | 0.9964 | 0.0036 | 2945 | 0.00196 | 7 | 6.64 | 302.1 | good |
| Example 42 | 0.55 | 0.9901 | 0.0099 | 2955 | 0.00200 | 7 | 6.62 | 301.5 | good |
| Example 43 | 026 | — | — | 651 | 0.00088 | 60 | 6.01 | 357.1 | good |
| Example 44 | 0.26 | 0.9991 | 0.0009 | 656 | 0.00101 | 60 | 6.04 | 355.6 | good |
| Example 45 | 0.30 | 0.9800 | 0.0200 | 701 | 0.00200 | 7 | 6.43 | 302.1 | good |
| Example 46 | 0.30 | 0.9991 | 0.0009 | 606 | 0.00102 | 80 | 6.41 | 301.1 | good |
| Example 47 | 0.30 | 0.9991 | 0.0009 | 606 | 0.00102 | 540 | 6.35 | 340.1 | good |

TABLE 1-continued

| | x | α | 1-α | Dielectric constant of line portion composed of first dielectric (=first dielectric constant) | Dielectric loss in line portion composed of first dielectric (=first dielectric loss) | Surrounding dielectric portion composed of second dielectric (=second relative permittivity) | Resonant frequency when transmission line and electronic component are formed into shapes (GHz) | Unloaded Q value when transmission line and electronic component are formed into shapes | Assessment compared to unloaded Q value when Ag is used (Qu = 300) |
|---|---|---|---|---|---|---|---|---|---|
| Example 48 | 0.30 | 0.9801 | 0.0199 | 603 | 0.00099 | 7 | 6.32 | 330.5 | good |
| Comparative Example 1 | 0.25 | — | — | 500 | 0.00081 | 7 | 6.24 | 260.1 | deteriorate |
| Comparative Example 2 | 0.60 | — | — | Not measurable | Not measureable | 7 | Not measurable | Not measurable | Not measurable |
| Comparative Example 3 | 0.25 | 0.9991 | 0.0009 | 502 | 0.00083 | 7 | 6.24 | 256.5 | deteriorate |
| Comparative Example 4 | 0.25 | 0.9983 | 0.0017 | 511 | 0.00082 | 7 | 6.43 | 243.5 | deteriorate |
| Comparative Example 5 | 0.25 | 0.9974 | 0.0026 | 519 | 0.00079 | 7 | 6.32 | 241.3 | deteriorate |
| Comparative Example 6 | 0.25 | 0.9966 | 0.0034 | 534 | 0.00076 | 7 | 6.34 | 233.4 | deteriorate |
| Comparative Example 7 | 0.60 | 0.9991 | 0.0009 | Not measurable | Not measurable | 7 | Not measurable | Not measurable | Not measurable |
| Comparative Example 8 | 0.60 | 0.9982 | 0.0018 | Not measurable | Not measurable | 7 | Not measurable | Not measurable | Not measurable |
| Comparative Example 9 | 0.60 | 0.9973 | 0.0027 | Not measurable | Not measurable | 7 | Not measurable | Not measurable | Not measurable |
| Comparative Example 10 | 0.60 | 0.9964 | 0.0036 | Not measurable | Not measurable | 7 | Not measurable | Not measurable | deteriorate |
| Comparative Example 11 | 0.30 | 0.9991 | 0.0009 | 606 | 0.00102 | 606 | Not measurable | Not measurable | deteriorate |

Examples 2 to 7

A sintered body was prepared by using a same method as in Example 1 except that the composition of each dielectric powder was adjusted in accordance with Table 1. The composition of each prepared body was shown in Table 1.

Examples 8 to 42

A sintered body was prepared by using a same method as in Example 1 except that the powder described in Example 1 and MnO powder was adjusted as shown in Table 1 to provide the composition of each dielectric powder. The composition of each prepared body was shown in Table 1.

Examples 43 to 44

A sintered body was prepared by using a same method as in Example 1 and Examples 8 to 42 except that the composition of each dielectric powder for the line portion was adjusted in accordance with Table 1.

In addition, the surrounding dielectric portion was prepared by mixing the compounds described below with desired ratios.

Firstly, the powder of $MgCO_3$ and that of $SiO_2$ were weighted in a molar ratio between them being 2:1. These two kinds of powder were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours to provide forsterite $Mg_2SiO_4$.

Secondly, the powder of $CaCO_3$ and that of $TiO_2$ were weighted in a molar ratio between them being 1:1. These two kinds of powder were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours to provide calcium titanate $CaTiO_3$.

As a desired ratio of the forsterite to the calcium titanate which rendered these two materials function as the surrounding dielectric portion composed of the second dielectric, in Example 36, 80 parts by weight of calcium titanate and 20 parts by weight of forsterite were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours.

The pre-calcined powder mentioned above was fractionated and then mixed with ethanol for 24 hours in a ball mill. After the mixed slurry was heated and dried at 80° C. to 120° C. in several stages, it was cracked by an agate pestle and crossed through a #300 mesh sieve to be granulated so as to provide a dielectric powder having the composition as shown in Table 1.

Commercially available acryl resin based lacquer solution was added to the dielectric powder obtained by the method mentioned above in an amount of 8 mass % in term of the solid content of resins relative to the mass of the dielectric powder. Then, the mixture was mixed in an agate pestle and crossed through a #300 mesh sieve to be granulated. In this way, the granulated powder was obtained. The granulated powder was put into a mold and molded under an increased pressure to provide a formed body sample with a cylindrical shape. After a treatment to remove the binder done in air at 350° C., the sample was subjected to a thermal treatment at 1400° C. for a certain period of time. Then, it was cooled down to room temperature to finish the sintering process. In this respect, a sintered body was obtained which was the surrounding dielectric portion composed of the second dielectric.

In addition, the obtained line portion composed of the first dielectric and the surrounding portion composed of the second dielectric were used to form the shapes of the transmission line and the electronic components as shown in FIG. 1.

Examples 45 to 46

A sintered body was prepared by a same method as in Examples 8 to 42 and Example 44 except that the composition of each dielectric powder for forming the line portion was adjusted in accordance with Table 1.

Example 47

A sintered body was prepared by a same method as in Examples 8 to 42 and Examples 44 to 46 except that the composition of each dielectric powder for the line portion was adjusted in accordance with Table 1.

In addition, the surrounding dielectric portion was prepared by mixing the compounds described below with desired ratios.

Firstly, the powders of $SrCO_3$, $TiO_2$ and $BaTiO_3$ were weighted in a molar ratio among them being 7:7:3. The powders were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours to provide barium-strontium titanate $(SrBa)TiO_3$.

Secondly, the powders of $CaCO_3$ and $TiO_2$ were weighted in a molar ratio between them being 1:1. The powders were mixed with pure water and commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made alumina and calcined at a temperature of 1200 to 1240° C. for 2 hours to provide calcium titanate $CaTiO_3$.

As a desired ratio of barium-strontium titanate to calcium titanate which rendered these two materials function as the surrounding dielectric portion composed of the second dielectric, in Example 47, 90 parts by weight of barium-strontium titanate and 10 parts by weight of calcium titanate were mixed with pure water and commercially available anionic dispersant for 24 hours in a ball mill to provide a mixed slurry. The mixed slurry was heated and dried at 120° C., and then it was cracked by an agate pestle. Then, it crossed through a #300 mesh sieve to be granulated. Thereafter, the resultant substance was put into a crucible made alumina and pre-calcined at a temperature of 1200 to 1240° C. for 2 hours.

The pre-calcined powder mentioned above was fractionated and then mixed with ethanol for 24 hours in a ball mill. After the mixed slurry was heated and dried at 80° C. to 120° C. in several stages, it was cracked by an agate pestle and crossed through a #300 mesh sieve to be granulated so as to adjust the dielectric powder to have the composition as shown in Table 1.

Commercially available acryl resin based lacquer solution was added to the dielectric powder obtained by the method mentioned above in an amount of 8 mass % in term of the solid content of resins relative to the mass of the dielectric powder. Then, the mixture was mixed in an agate pestle and crossed through a #300 mesh sieve to be granulated. In this way, the granulated powder was obtained. The granulated powder was put into a mold and molded under an increased pressure to provide a formed body sample with a cylindrical shape. After a treatment to remove the binder was done in air at 350° C., the sample was subjected to a thermal treatment at 1400° C. for a certain period of time. Then, it was cooled down to room temperature to finish the sintering process. In this respect, a sintered body was obtained which was the surrounding dielectric portion composed of the second dielectric.

In addition, the obtained line portion composed of the first dielectric and the surrounding portion composed of the second dielectric were used to form the shapes of the transmission line and the electronic components as shown in FIG. 1.

Example 48

A sintered body was prepared by a same method as in Example 1 except that the powder described in Example 1 and MnO powder was adjusted as shown in Table 1 to provide the composition of each dielectric powder. The composition of each prepared body was shown in Table 1.

Comparative Examples 1 to 11

A sintered body was prepared by a same method as in Example 1 except that the composition of each dielectric powder was adjusted in accordance with Table 1. In addition, the shapes of the transmission line and the electronic component were formed as shown in FIG. 1. The composition of each prepared body was shown in Table 1.

Assessment

The relative permittivity and the value of dielectric loss of the obtained sintered body, and the resonant frequency and the unloaded Q value when the transmission line and the electronic components are formed into shapes as shown in FIG. 1 were respectively calculated.

Measurement on Dielectric Properties

The dielectric properties of the sintered body in the present embodiment could be assessed via the Q·f value and the relative permittivity $\in r$. The relative permittivity and the dielectric loss could be measured according to "the method for testing dielectric properties of fine ceramics for microwave", Japanese Industrial Standards (JIS R1627, 1996).

As for the assessment of the dielectric properties, the resonant frequency and the Q value were obtained by Hakki-Coleman method (a method involving dielectric resonate with both ends short-circuited). Then, the relative permittivity and the dielectric loss were calculated based on the size, resonant frequency and Q value of the fired body (sintered body).

Resonant Frequency and Unloaded Q Value When Shapes of Dielectric Line and Electronic Component were Formed As shown in FIG. 1, an electronic component 1 of the present embodiment contained a dielectric line 2 of the present embodiment. The transmission line 2 was provided with a line portion 10 composed of a first dielectric and a surrounding dielectric portion 20 composed of a second dielectric. The dielectric obtained in the foregoing Examples was used to form into such a shape. The resonant frequency and the unloaded Q value were respectively measured in the dielectric which functioned as an electronic component and were also recorded in Table 1. In Table 1, an unloaded Q value of 300 was used in comparison to determine whether the unloaded Q value was good or not, wherein, the unloaded Q value of 300 was obtained when a conductor electrode made of the metal Ag itself was used in a conventional transmission line in the line portion 10. The result was recorded.

It could be seen from Table 1 that Examples 1 to 48 were within the range of the present invention and each Qu value of the electronic component was larger than 300 which was obtained when a conductor electrode made of metal Ag itself was used in the line portion.

Also, it could be known from Table 1 that Comparative Examples 1 to 11 went beyond the range of the present invention and each Qu value of the electronic component was not larger than 300 which was obtained when a conductor electrode made of metal Ag itself was used in the line portion.

As for Comparative Example 2 and Comparative Examples 7 to 11, in the measurement of the first relative permittivity, the resonant frequency cannot be confirmed and thus the first relative permittivity cannot be measured. Therefore, the Qu value cannot be measured either.

DESCRIPTION OF REFERENCE NUMERALS

1 electronic component
2 transmission line
3 conductor layer
4 conductor layer
5 conductor layer
6 conductor layer
7 conductor layer
7*a* end portion of conductor layer
10 line portion
20 surrounding dielectric portion
20*a* upper surface
20*b* lower surface
20*c* side surface
20*d* side surface
20*e* side surface
20*f* side surface
30 resonator
31 inductor
32 capacitor
33 input/output terminal

What is claimed is:

1. A transmission line comprising
a line portion composed of a first dielectric with a first relative permittivity, and
a surrounding dielectric portion composed of a second dielectric with a second relative permittivity, wherein,
the first dielectric is represented by a formula of $\{XBaO.(1-X)SrO\}TiO_2$, wherein $0.25<X\leq 0.55$, and
the second relative permittivity is smaller than the first relative permittivity.

2. The transmission line of claim 1, wherein,
the first dielectric comprises MnO and is represented by a formula of $\alpha\{XBaO.(1-X)SrO\}TiO_2+(1-\alpha)MnO$, wherein, $0.9800<\alpha<1.0000$, $0.25<X\leq 0.55$.

3. The transmission line of claim 1, wherein,
the second relative permittivity is one tenth of the first relative permittivity or even smaller.

4. An electronic component comprising a resonator, wherein,
the resonator comprises the transmission line of claim 1,
the transmission line transmits electromagnetic waves of at least one frequency ranging from 1 GHz to 10 GHz.

5. The transmission line of claim 2, wherein,
the second relative permittivity is one tenth of the first relative permittivity or even smaller.

6. An electronic component comprising a resonator, wherein,
the resonator comprises the transmission line of claim 2,
the transmission line transmits electromagnetic waves of at least one frequency ranging from 1 GHz to 10 GHz.

7. An electronic component comprising a resonator, wherein,
the resonator comprises the transmission line of claim 3,
the transmission line transmits electromagnetic waves of at least one frequency ranging from 1 GHz to 10 GHz.

8. An electronic component comprising a resonator, wherein,
the resonator comprises the transmission line of claim 5,
the transmission line transmits electromagnetic waves of at least one frequency ranging from 1 GHz to 10 GHz.

* * * * *